US009888754B2

(12) United States Patent
Billingham

(10) Patent No.: US 9,888,754 B2
(45) Date of Patent: Feb. 13, 2018

(54) CONTAINER ASSEMBLY

(71) Applicant: M. Billingham & Co. Limited, West Midlands (GB)

(72) Inventor: Martin Billingham, West Midlands (GB)

(73) Assignee: M. Billingham & Co. Limited, West Midlands (GB)

( * ) Notice: Subject to any disclaimer, the term of this patent is extended or adjusted under 35 U.S.C. 154(b) by 0 days.

(21) Appl. No.: 15/124,549

(22) PCT Filed: Feb. 26, 2015

(86) PCT No.: PCT/EP2015/053979

§ 371 (c)(1),
(2) Date: Sep. 8, 2016

(87) PCT Pub. No.: WO2015/135756

PCT Pub. Date: Sep. 17, 2015

(65) Prior Publication Data

US 2017/0013926 A1 Jan. 19, 2017

(30) Foreign Application Priority Data

Mar. 12, 2014 (GB) ..... 1404344.2

(51) Int. Cl.
*A45C 11/38* (2006.01)
*A45C 13/02* (2006.01)
*B65D 25/06* (2006.01)

(52) U.S. Cl.
CPC ..... *A45C 11/38* (2013.01); *A45C 13/02* (2013.01); *B65D 25/06* (2013.01); *A45C 2013/026* (2013.01)

(58) Field of Classification Search
CPC ..... A45C 11/38; A45C 11/00; A45C 13/02; B65D 25/04; B65D 25/06
(Continued)

(56) References Cited

U.S. PATENT DOCUMENTS 1,644,830 A * 10/1927 Henderson ..... A61F 17/00 206/232
1,823,285 A * 9/1931 Petritsch ..... A47B 88/90 211/184
(Continued)

FOREIGN PATENT DOCUMENTS

CN 2769189 4/2006
CN 202743614 2/2013
(Continued)

OTHER PUBLICATIONS

International Search Report and Written Opinion for PCT/EP2015/053979 dated Apr. 1, 2015.
(Continued)

*Primary Examiner* — Robert J Hicks
(74) *Attorney, Agent, or Firm* — Warner Norcross + Judd LLP

(57) ABSTRACT

A container assembly (10) includes a container (12) for storing an item such as a camera. The container (12) may be partitioned by a divider (14). The container (12) includes first connectors (22) which define a plurality of possible divider positions. The first connectors (22) are arranged to align with second connectors (32) of the divider (14) when the divider (14) is placed in a divider position to form engagement pairs which may receive a common retaining element (16) to hold the divider (14) in place at the divider position.

9 Claims, 4 Drawing Sheets

(58) Field of Classification Search
USPC ..... 220/533, 532, 529, 534, 544, 545, 546; 217/10, 7; 206/316.2, 316.1
See application file for complete search history.

(56) References Cited

U.S. PATENT DOCUMENTS

| | | | | |
|---|---|---|---|---|
| 1,932,772 | A * | 10/1933 | Eschenbach | B65D 7/12 217/12 R |
| 4,260,004 | A | 4/1981 | Domke | |
| 4,499,997 | A * | 2/1985 | Swingley, Jr. | B65D 21/0219 206/427 |
| 4,828,133 | A | 5/1989 | Hougendobler | |
| 6,227,389 | B1 * | 5/2001 | Merkel | A47B 96/04 206/383 |
| 2005/0115972 | A1 | 6/2005 | Osborn | |
| 2007/0068952 | A1 | 3/2007 | Leytens | |
| 2011/0156439 | A1 | 6/2011 | Sakata | |
| 2013/0325885 | A1 * | 12/2013 | Levy | G06F 9/44505 707/758 |

FOREIGN PATENT DOCUMENTS

| | | | |
|---|---|---|---|
| DE | 29902518 | U | 5/1999 |
| DE | 20211459 | U | 10/2002 |
| EP | 1845024 | | 10/2007 |
| GB | 2209462 | | 5/1989 |
| GB | 2281289 | | 3/1995 |
| WO | 2004096654 | | 11/2004 |
| WO | 2008135391 | | 11/2008 |

OTHER PUBLICATIONS

Combined Search and Examination Report Under Sections 17 & 18(3) for Application No. GB1404344.2 dated Aug. 4, 2014.

* cited by examiner

CONTAINER ASSEMBLY

BACKGROUND

It is known to store an item such as a camera in a protective containment article that is arranged reduce the likelihood of the item being damaged while not in use. Examples of containment articles are bags, boxes, cases and the like, or removable container inserts for such articles. For brevity, these types of containment articles will be referred to herein as a 'container'.

Items such as cameras may be arranged to be used with detachable component parts, such as lenses, batteries, memory devices, stands or the like. It can be advantageous for a container to define a plurality of internal sub-compartments, such that an item can be stored within a first sub-compartment, and a component part of the item can be stored separately within a second sub-compartment.

It is known to create sub-compartments within a container by providing one or more partitioning walls within the compartment. Such partitioning walls are known in the art as 'dividers'.

A divider may be integrally formed with the container. However, while this approach generally results in securely defined sub-compartments, the sub compartments are of a fixed size.

Alternatively, in order to provide flexibility, it is known to provide user configurable dividers arranged to be removably attached to internal side walls of a container. It is common for dividers to be configured to be attached to a container by Velcro™ so as to enable various possible divider configurations.

SUMMARY

According to a first aspect of the invention, there is provided a container assembly comprising:

- a container which defines an internal compartment and includes first connectors arranged to define a plurality of possible divider positions within the compartment;
- one or more dividers, each divider being arranged to be positioned within the compartment in one of the divider positions to partition the compartment into a plurality of sub-compartments, the one or more dividers each including second connectors; and
- a plurality of retaining elements, wherein the first and second connectors each include an engagement surface and the container assembly is arranged such that, when one of the dividers is positioned at one of the dividing positions within the compartment, a plurality of the second connectors each overlaps a respective first connector in an engagement axis to form an engagement pair, the engagement surfaces of connectors within an engagement pair defining a space between them that reduces in size as the divider is moved from the dividing position and is sized to receive one of the retaining elements to inhibit movement of the divider from the dividing position.

Thus, the container assembly enables sub-compartments to be securely defined due to movement of the divider(s) being inhibited by retaining elements located within the spaces defined between the engagement surfaces of the first and second connectors. Embodiments of the invention may have one or more of the following advantages:

- the connectors and retaining elements can be lightweight.
- the connectors can be softly shaped so as not to scratch items or detachable parts.

- a plurality of connector pairs can be aligned to receive a common retaining element, thereby simplifying configuration of a divider.

Additionally, one or more of the dividers may each includes a first side and a second side, each of the first and second sides comprising one or more of the second connectors. A side need not be the edge face of a divider.

Additionally or alternatively, each side of the divider may comprise a plurality of second connectors in order to provide a more secure connection between the divider and container. Thus, a plurality of engagement pairs may be formed on each side of the divider.

Additionally or alternatively, the distance between the furthest apart of the second connectors on a respective side of the divider is at least 50% of the height of the divider, in some cases at least 75% of the height and in some cases at least 90% of the height; increased separation between the furthest apart of the second connectors on a respective side of the divider may provide improved partitioning in cases where the divider is formed from a flexible material.

At least three second connectors may be provided on a respective side of the divider. This may contribute to a secure connection; where a heavy item is to be retained, it is preferred that at least four, and in some cases at least five second connectors are provided on a respective side of the divider.

Additionally or alternatively, each side of the divider may include a rigid member from which the second connectors on a respective side of the divider extend. The rigid member may provide one or more of the following advantages: holding the second connectors in alignment; and providing rigidity to the divider when a flexible barrier material is used.

The divider may me sized to define a barrier over a major part of the internal cross sectional area of a container.

Additionally or alternatively, the container assembly may be arranged such that, with the divider positioned in a divider position, the connectors of one or more engagement pairs are adjacent one another.

Alternatively or in addition, the retaining elements may be elongate and sized to extend through a majority of the second connectors on a respective side of the divider. The retaining elements may greater in length than the distance between the furthest apart of the second connectors on a respective side of the divider.

Additionally or alternatively, the first connectors may be arranged into one or more sets, each set defining a divider position. The first connectors of a set may be generally aligned in a plane which is generally parallel with respect to and intersects a divider position.

Additionally or alternatively, each first connector and second connector may include a retaining channel sized for receiving one of the retaining elements and wherein, when one of the dividers is positioned at one of the dividing positions within the compartment, the retaining channels of both connectors within an engagement pair become aligned to receive a common retaining element.

Additionally or alternatively, the container may include one or more walls comprising an inner panel with respect to the compartment, the inner panel including a plurality of holes each sized to receive one or the second connectors and position it relative to an associated first connector. The first connectors may be defined by a wall of the container which includes holes sized to receive the second connectors. The channels of the first connectors may be collectively defined by a space on the opposite side of the container wall with respect to the compartment. It is preferred however that the wall of the container defines channels corresponding to each engagement axis to assist guidance of a retaining element; thus, the one or more walls may include an outer panel located on an opposite side of the inner panel with respect to the compartment, the panels being spaced apart from one another in a parallel relationship by spacer elements, the spacer elements being arranged to define wall channels having axes defining engagement axes. The spacer elements may be are arranged to define a plurality of generally orthogonal wall channels each of which intersects one or more other wall channels. In some embodiments the one or more walls are defined by a three dimensional mesh material.

In accordance with a second aspect of the present invention, there is provided a divider arranged for use with a container assembly according to the first aspect, the divider being arranged to be positioned within the compartment in one of the divider positions to partition the compartment into a plurality of sub-compartments, the divider including second connectors each including a retaining channel sized for receiving one of the retaining elements such that, when the dividers is positioned at one of the dividing positions within the compartment, a plurality of the second connectors each overlaps a respective first connector in an engagement axis to form an engagement pair, the retaining channels of both connectors within an engagement pair being aligned to receive a common retaining element to inhibit movement of the divider from the dividing position.

In accordance with a third aspect of the present invention, there is provided a divider assembly including a divider according to the second aspect and a plurality of retaining elements.

In accordance with a fourth aspect of the present invention, there is provided a container arranged for use with a container assembly according to the first aspect, the container defining an internal compartment and including first connectors arranged to define a plurality of possible divider positions within the compartment;

wherein the first include an engagement surface such that when a divider is positioned at one of the dividing positions within the compartment, a plurality second connectors of the divider each overlaps a respective first connector in an engagement axis to form an engagement pair, the engagement surfaces of connectors within an engagement pair defining a space between them that reduces in size as the divider is moved from the dividing position and is sized to receive a retaining element to inhibit movement of the divider from the dividing position.

Optional features of the first aspect are equally applicable to the second, third and fourth aspects.

BRIEF DESCRIPTION OF THE DRAWINGS

Embodiments of the invention will now be described with reference to the accompanying drawings, in which.

DETAILED DESCRIPTION

Figure 1A:
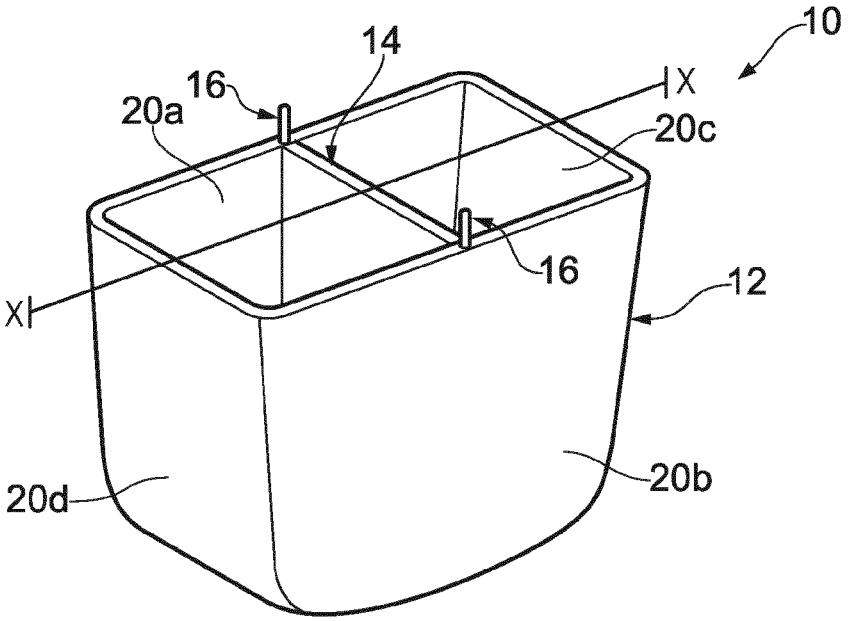
FIG. 1*a* is a schematic diagram of a container assembly according to an embodiment of the present invention.

As an explanatory overview, embodiments of the invention provide a container assembly 10 which includes a container 12 for storing an item such as a camera. The container 12 may be partitioned by a divider 14. The container 12 includes first connectors 22 which define a plurality of possible divider positions. Each first connector 22 has an engagement surface. The divider 14 is provide with second connectors 32, each of which has an engagement surface. The first connectors 22 are arranged to form engagement pairs with the second connectors 32 when the divider 14 is placed in a divider position. A space exists between the engagement surfaces of both connectors within an engagement pair, the space being arranged to reduce in size as the divider 14 moves away from the divider position. The space is sized to receive a retaining element 16 to hold the divider 14 in place at the divider position.

Figure 1B:
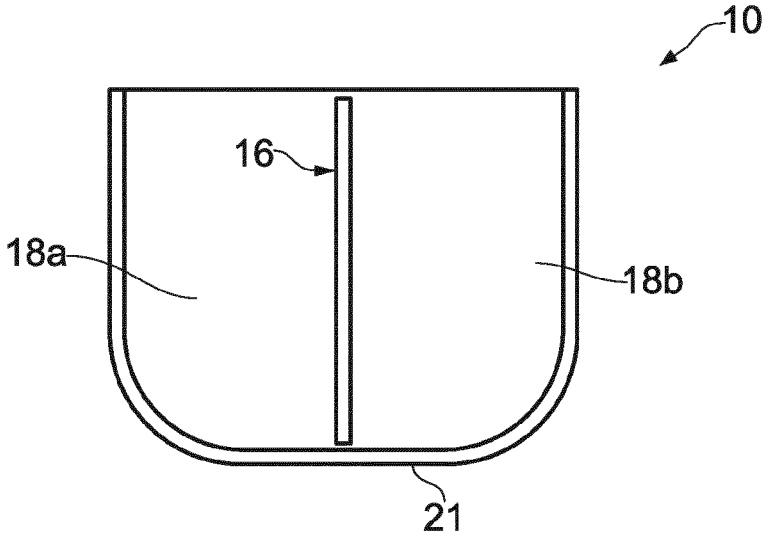
FIG. 1*b* is a schematic diagram of the container assembly of FIG. 1*a* in cross section through X-X.

FIGS. 1*a* and 1*b* schematically shows a container assembly 10 according to an embodiment of the present invention. The container assembly 10 includes a container 12, a divider 14 and a plurality of retaining elements 16 for holding the divider 14 in place with respect to the container 12. In other embodiments, the container 12 may take any suitable form and the container assembly 10 may include a plurality of dividers 12 with associated retaining elements.

The container 12 has two major side walls 20*a*, 20*b* joined at their side regions to side regions of minor sidewalls 20*c*, 20*d*. The bottom region of each side wall 20*a*-20*d* is joined to side regions of a base 21. The base 21 and side walls 20*a*-20*d* may be formed of any suitable material, such as a plastics material, metal, wood, woven textile, non woven textile, or leather. The container 12 defines an internal compartment that is generally divided by the divider 14 into a first sub-compartment 18*a* and a second sub-compartment 18*b*. The top of the container 12 is open. Each sub-compartment 18*a*, 18*b* is arranged to receive an item, such as a camera, or one or more component parts, for storage.

Referring additionally to FIGS. 2*a* to 2*d*, the walls 20*a*-20*d* of the container 12 which define the compartment include first connectors 22 arranged to define a plurality of possible divider positions 24 within the compartment.

In the illustrated embodiment, the first connectors 22 are grouped into sets, with each set defining a possible divider position 24. The first connectors 22 within a set are arranged in a pattern which corresponds to the lateral shape of a divider 14, to facilitate engagement therewith. Each wall 20*a*-20*d* is formed of an inner wall panel 202 and an outer wall panel 204 connected to one another in a spaced parallel relationship by spacer elements 206. The spacer elements 206 may be formed of any suitable material; for example, a plastics material, preferably a foam. The spacer elements are arranged to define a series of elongate, vertical wall channels 28 which extend from the top face of a wall 20*a*-20*d* towards, and in some cases to, the bottom face. Each wall channel 28 has a longitudinal axis can be thought of as an engagement axis. The inner wall panel 202 includes an array of holes 26 configured to receive second connectors 32 of the divider 14. The holes 26 are configured to position second connectors 32 of the divider 14 in one of the wall channels 28, and therefore in an engagement axis, when the second connectors 32 of the divider 14 are received by the holes 28 of a particular set. The holes 26 may be any suitable size, such as 5 mm in diameter, and may be any suitable shape; for example, an elongate slit or slot.

Although the term 'set' of holes 26 has been used so far to describe a series of holes which extend vertically, sets may also extend horizontally providing that spaces corresponding to engagement axes for the sets are defined by the container; in the illustrated embodiment, this is achieved by a series of elongate, horizontal wall channels 29.

In other embodiments, the container 10 may take any suitable form in which it defines an internal compartment and includes a plurality of first connectors 22 arranged to define a plurality of possible divider positions within the compartment, each first connector defining an engagement surface 22'; for example, the structure of the first connectors defined by the walls 20*a*-20*d* of the illustrated embodiment could alternatively be implemented by a three dimensional woven or non woven textile; for example a three dimensional printed structure. In other embodiments, container walls 40 include the first connectors 22 that may be defined simply in a generally planar array, as described below in relation to FIGS. 4*a* and 4*b*. In other embodiments, the first connectors 22 may be defined by an array of hoops arranged in sets, the axis of each hoop within a set being coaxially aligned to define an engagement axis.

Figure 2C:
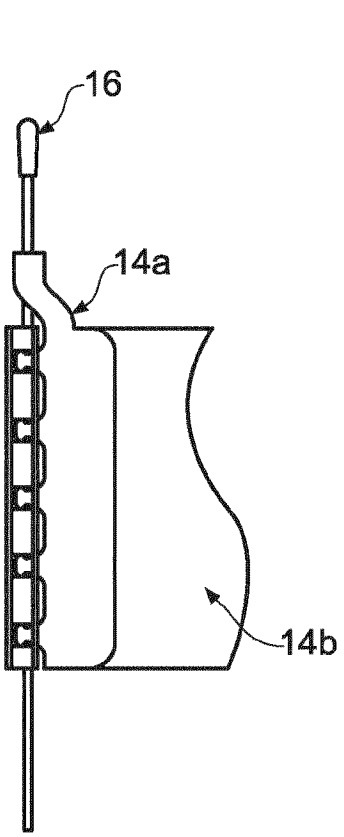
FIGS. 2*a* to 2*d* are schematic diagrams of a container wall of the container assembly of FIG. 1*a* with a divider engaged in a divider position, the first and second connectors being aligned in an engagement axis and retained by a common retaining element.
Figure 2D:
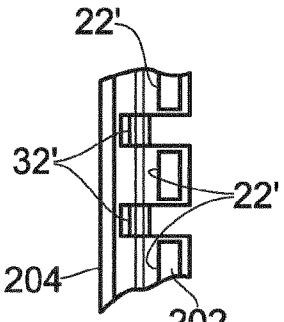
Figure 2B:
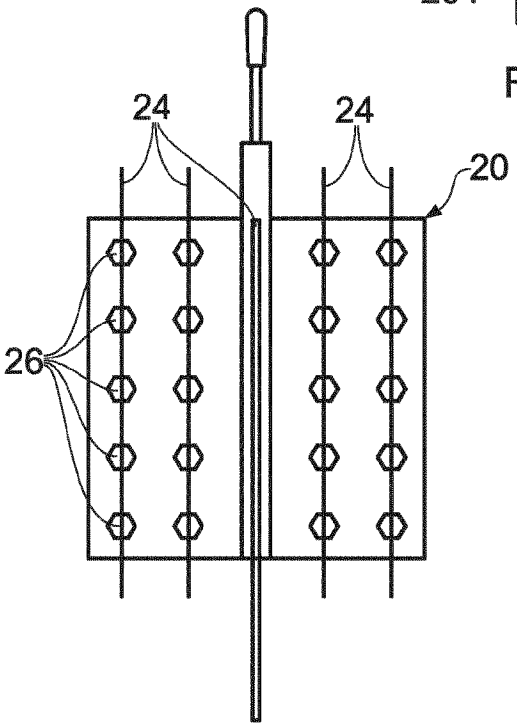
Figure 2A:
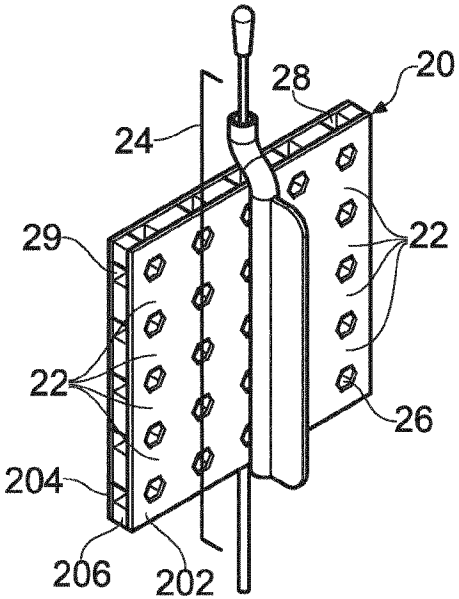

As such, in the illustrated embodiment, the engagement surfaces 22' of the first connectors 22 are defined by engagement portions of the inner wall panel 202 disposed between the holes 26 of a set, as illustrated in FIG. 2*d*. The wall channel 28 serves to define a retaining channel for each second connector 32, which may help guide a retaining element into position.

Figure 3A:
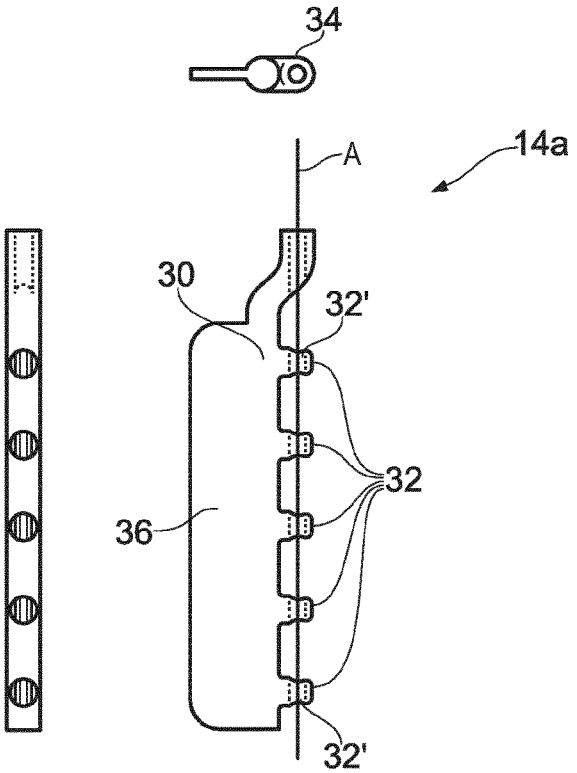
FIG. 3*a* is a schematic front, side and plan view of the anchor element of the divider shown in FIGS. 2*a* to 2*c;*
Figure 3B:
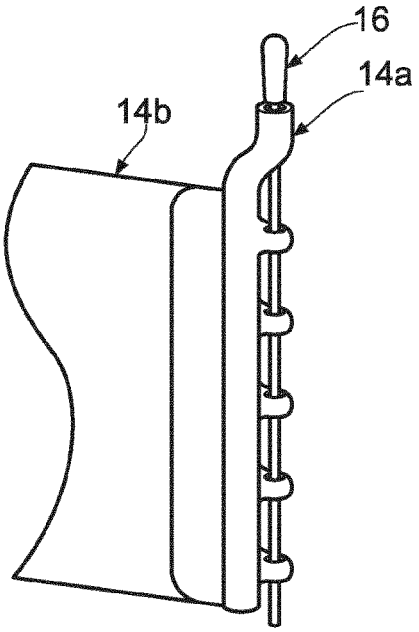
FIG. 3*b* is a schematic perspective view of the anchor element of FIG. 3*a* showing a retaining element within the retaining channels of the second connectors.

Referring additionally to FIGS. 3*a* and 3*b*, the divider 14 includes a pair of anchor elements 14*a* (only one of which is shown) between which a barrier panel 14*b* is provided. Each anchor element 14*a* is configured to engage with a set of first connectors 22. Each anchor element 14*a* comprises a rigid, elongate body 30 from which a set of the second connectors 32 protrude in a generally lateral direction. Each second connector 32 includes an inner surface which defines a retaining channel 34 extending through it. The retaining channels 34 are configured such that they can be generally coaxially aligned with an engagement axis. The retaining channels 34 of each second connector 32 of an anchor element 14*a* are coaxially aligned such that an elongate retaining element 16 may extend through the second connectors 32 of the set, as illustrated in FIG. 3*b*. The barrier panel 14*b* is arranged to be joined to an elongate tab 36 of the body 30. The barrier panel 14*b* may be flexible or rigid and may be formed of any suitable material, such as a plastics material, metal, wood, woven textile, non woven textile, or leather.

As such, the distal portion 32' of the inner surface that defines a retaining channel 34 of a second connector 32 acts as an engagement surface 32' that engages a positioned retaining element 16 and forces the retaining element 16 against first connector wall portions 22 that are aligned with the engagement axis, so as to inhibit removal of the divider from the divider position.

In other embodiments, a divider may take any suitable form in which it is configured to be positioned within the compartment in one of the divider positions to partition the compartment into a plurality of sub-compartments and includes a plurality of second connectors.

The retaining elements 16 are elongate, rigid rods with enlarged tips to aid in manipulation by a user. The tips may be smooth, as they may be exposed when in place. The retaining elements 16 may be formed of any suitable material, such as metal or a hard plastics material. It is preferred that the retaining elements 16 are arranged to engage with the divider 14 when in the retaining position.

In use, the user aligns a divider 14 at the divider position 24 and inserts the second connectors 32 of one of the divider anchor element 14*a* into the holes 26 of the set which corresponds to the required divider position 24. In doing so the engagement surfaces 32' of the second connectors 32 move from being on the same side of the engagement axis as the engagement surfaces 22' of the first connectors 22, to being on an opposite side of the engagement axis in comparison to the engagement surfaces 22' of the first connectors 22. Thus, a space is created between the engagement surfaces 22', 32' within which space the engagement axis exists. Once the second connectors 32 are received sufficiently such that the space is wide enough to receive a retaining element 16, the user may insert a retaining element 16 down the vertical wall channel 28 and through each retaining channel 34. The user may then engage the second anchor element 14*a* into a set of holes 26 on the opposing wall of the container in a similar manner; in cases where the divider 14 is not flexible, the user may deform the container 12 to increase the distance between the two sets of holes 26. Initial movement of the divider 14 from the divider position will reduce the width of the space between the engagement surfaces 22', 32', eventually causing the engagement surfaces 22', 32' to engage opposing side of the retaining element 16 to inhibit removal of the second connectors 32 from the holes 26.

Embodiments of the invention enable a secure connection to be made between the divider 14 and container 12 due to the fact a retaining element is inserted through the engagement channels of a pair consisting of a first connector 22 and a second connector 32; such a pair will be referred to herein as an 'engagement pair'.

It is preferred that the connectors of an engagement pair are adjacent because in such cases a force attempting to move the divider is reacted locally i.e. the retaining element experiences a low bending moment due to the close proximity of the connectors. This enables the retaining element to be relatively lightweight.

It is preferred that the container system 10 is arranged to define a plurality of engagement pairs on each side of a divider 14, preferably at least three, four or five, as this may lead to a particularly secure connection, while also being simple to operate due to a user merely being required to insert an elongate retaining element into a set of generally coaxial holes. Preferably, a divider 14 and container 12 are arranged to define an engagement pair towards the top of the divider 14 an engagement pair towards the bottom of the divider 14, with further engagement pairs preferably being defined between the upper and lower pair. Preferably, a plurality of engagement pairs on each side of the divider have coaxially aligned engagement channels for receiving a common retaining element.

Figure 4A:
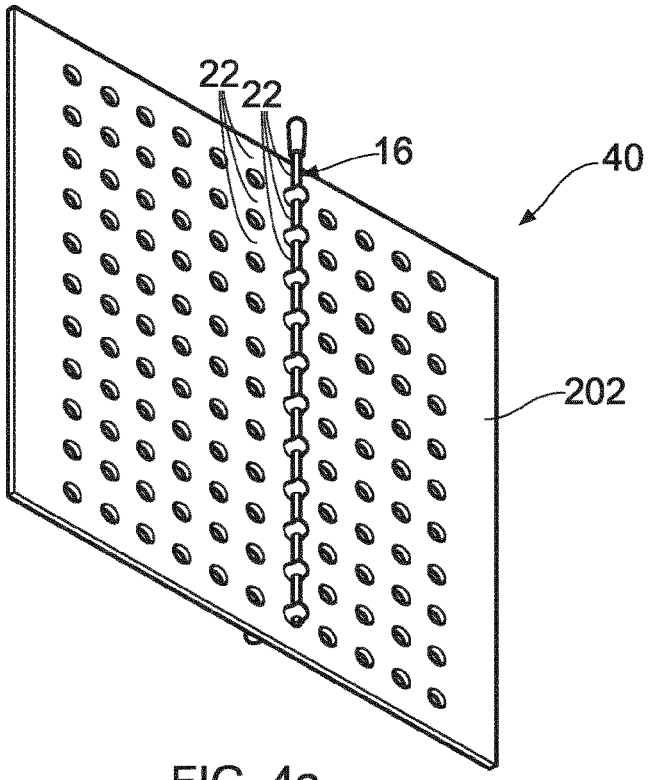
FIG. 4*a* is a schematic perspective view of parts of a container assembly according to a further embodiment of the invention, viewed from the exterior of the container, in which the second connectors are defined by a single skinned wall.
Figure 4B:
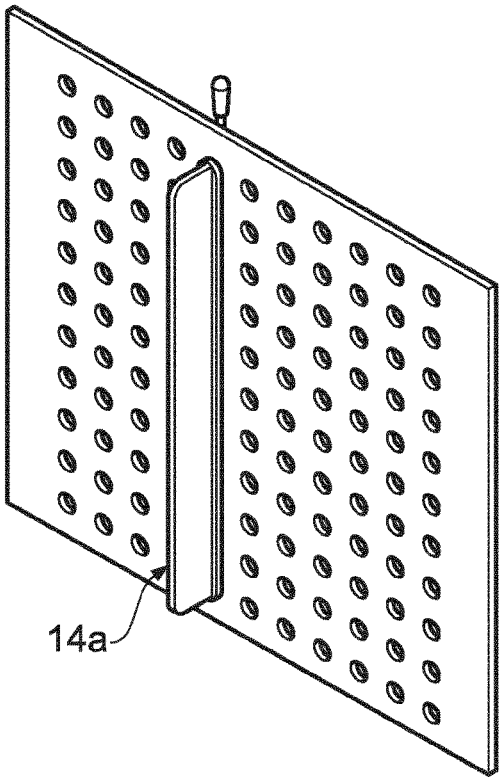
FIG. 4*b* is a schematic perspective view of the parts of the container assembly of FIG. 4*b*, viewed from inside the container.

In embodiments of the invention, the connectors 22, 32 may take any suitable form in which the first and second connectors each include an engagement surface and the container assembly is arranged such that, when one of the dividers is positioned at one of the dividing positions within the compartment, a plurality of the second connectors each overlaps a respective first connector in an engagement axis to form an engagement pair, the engagement surfaces of connectors within an engagement pair defining a space between them that reduces in size as the divider is moved from the dividing position and is sized to receive one of the retaining elements to inhibit movement of the divider from the dividing position; for example, as illustrated in FIGS. 4*a* and 4*b*, the first connectors 22 may my defined by a single layer wall 202 including holes 26 for receiving the second connectors 32. Alternatively, the first and second connectors may be defined by hoops which are brought into axial alignment when one of the dividers is positioned at one of the dividing positions within the compartment.

Although the invention has been described above with reference to one or more preferred embodiments, it will be appreciated that various changes or modifications may be made without departing from the scope of the invention as defined in the appended claims. The word "comprising" can mean "including" or "consisting of" and therefore does not exclude the presence of elements or steps other than those listed in any claim or the specification as a whole. The mere fact that certain measures are recited in mutually different dependent claims does not indicate that a combination of these measures cannot be used to advantage.

The invention claimed is:

1. A container assembly for storing a camera, the container assembly comprising:

a container including one or more walls with an array of holes arranged to define a plurality of selectable divider positions, each wall including wall channels associated with each of the plurality of divider positions;

one or more dividers extending between opposed container walls to partition the compartment into sub-compartments, each divider defining opposed lateral ends having a plurality of hoops extending therefrom for receipt within the holes of the container walls, the plurality of hoops defining a retaining channel; and two or more elongated retaining rods, wherein, when one of the dividers is positioned in a selected one of the plurality of divider positions, the plurality of hoops are disposed within the holes of the container wall, and the hoop retaining channel and wall channel align to form a common engagement channel adjacent each lateral end of the divider, each common engagement channel being sized to receive one of the two or more retaining rods to inhibit removal of the divider from the selected one of the plurality of divider positions.

2. The container assembly according to claim 1, wherein the two or more elongated retaining rods are greater in length than the distance between the farthest apart of the plurality of hoops on respective lateral ends of the divider.

3. The container assembly according to claim 1, wherein opposing walls of the container each include an array of holes that are arranged into one or more sets, each set defining a selected divider position.

4. The container assembly according to claim 3, wherein the arrays of holes forming the one or more sets are generally aligned along a divider positioning axis.

5. The container assembly according to claim 1 arranged such that, with the divider positioned in a divider position, the plurality of hoops and the wall channels that form the common engagement channel are adjacent one another.

6. The container assembly according to claim 1, wherein the container includes one or more walls comprising an inner panel with respect to the compartment, the inner panel including the array of holes each sized to receive one of the plurality of hoops and position the plurality of hoops relative to the wall channel.

7. The container assembly according to claim 6, wherein the one or more walls include an outer panel located on an opposite side of the inner panel with respect to the compartment, the panels being spaced apart from one another in a parallel relationship by spacer elements, the spacer elements being arranged to further define the wall channels having axes defining engagement axes.

8. The container assembly according to claim 7, wherein the spacer elements are arranged to define a plurality of generally orthogonal wall channels each of which intersects one or more other wall channels.

9. The container assembly according to claim 6, wherein the one or more walls are defined by a three dimensional mesh.

* * * * *